US008367932B2

(12) United States Patent
Matsumoto

(10) Patent No.: US 8,367,932 B2
(45) Date of Patent: Feb. 5, 2013

(54) FLAT CABLE

(75) Inventor: Osamu Matsumoto, Mito (JP)

(73) Assignee: Junkosha Inc., Ibaraki (JP)

( * ) Notice: Subject to any disclaimer, the term of this patent is extended or adjusted under 35 U.S.C. 154(b) by 405 days.

(21) Appl. No.: 12/450,245

(22) PCT Filed: Mar. 13, 2008

(86) PCT No.: PCT/JP2008/055165

§ 371 (c)(1),
(2), (4) Date: Sep. 18, 2009

(87) PCT Pub. No.: WO2008/123114

PCT Pub. Date: Oct. 16, 2008

(65) Prior Publication Data

US 2010/0089610 A1 Apr. 15, 2010

(30) Foreign Application Priority Data

Mar. 20, 2007 (JP) ..... 2007-073296

(51) Int. Cl.
*H01B 7/00* (2006.01)

(52) U.S. Cl. ..... 174/110 R; 174/117 R; 174/117 F

(58) Field of Classification Search ..... 174/110 R, 174/113 R, 117 R, 117 F, 117 FF
See application file for complete search history.

(56) References Cited

U.S. PATENT DOCUMENTS

| | | | | | |
|---|---|---|---|---|---|
| 3,582,537 | A | * | 6/1971 | Perreault | 174/117 M |
| 4,143,236 | A | * | 3/1979 | Ross et al. | 174/32 |
| 4,463,323 | A | * | 7/1984 | Piper | 333/1 |
| 4,559,411 | A | * | 12/1985 | Piper | 174/117 M |
| 4,712,298 | A | * | 12/1987 | Mondor, III | 29/861 |
| 5,089,669 | A | * | 2/1992 | Piper et al. | 174/117 M |
| 5,373,103 | A | * | 12/1994 | Orr et al. | 174/36 |
| 5,773,762 | A | * | 6/1998 | Orr et al. | 174/117 M |
| 5,900,587 | A | * | 5/1999 | Piper et al. | 174/117 F |

FOREIGN PATENT DOCUMENTS

| | | |
|---|---|---|
| JP | 61-18514 | 2/1986 |
| JP | 63-318010 | 12/1988 |
| JP | 10-513305 | 12/1998 |
| JP | 2001-101934 | 4/2001 |
| JP | 2005-322462 | 11/2005 |
| JP | 2006-196232 | 7/2006 |
| JP | 2006-286299 | 10/2006 |
| JP | 2007-257889 | 10/2007 |
| WO | WO 96/24142 | 8/1996 |

OTHER PUBLICATIONS

International Search Report, dated Jul. 15, 2008, corresponding to PCT/JP2008/055165.

* cited by examiner

*Primary Examiner* — William Mayo, III
(74) *Attorney, Agent, or Firm* — Christie, Parker & Hale, LLP.

(57) ABSTRACT

A flat cable including thin coaxial cables each having a center conductor and a jacket, parallel arranged two-dimensionally in a flat shape, and joined by tangling them with a weft yarn in units of predetermined number of very thin coaxial cables. The flat cable further includes tangling yarns that are arranged parallel along the edges in the width direction of the thin coaxial cables, and the elongation of the weft yarn is greater than that of the tangling yarn. When the very thin flat cable is bent, the bent portion of the weft yarn is elongated, and thereby the bent portion of the very thin coaxial cables can deviate from the mesh formed by the very thin coaxial cables and the weft yarn.

6 Claims, 4 Drawing Sheets

FLAT CABLE

CROSS-REFERENCE TO RELATED APPLICATION

This application is a National Phase Patent Application and claims the priority of International Application Number PCT/JP2008/055165, filed on Mar. 13, 2008, which claims priority of Japanese Patent Application Number 2007-073296, filed on Mar. 20, 2007.

FIELD OF THE INVENTION

The present invention relates to a flat cable.

BACKGROUND ART

Heretofore, the present applicant has provided a very thin flat cable in which a plurality of very thin coaxial cables are arranged in parallel and the plurality of adjacent very thin coaxial cables are assembled by weaving each of a predetermined number of very thin coaxial cables with a multiplicity of filaments without giving rise to deformation. Since the very thin coaxial cables are assembled by weaving each of a predetermined number of very thin coaxial cables with a multiplicity of thin flexible and stretchable filaments to provide the very thin flat cable, the flat cable has a large degree of freedom in the direction of bending or flexure. Further, when the coaxial cables are formed in a flat configuration, it is possible to reduce the adverse effect on electrical properties, such as the characteristic impedance of the very thin coaxial cables (JP 2001-101934 A (Japanese Patent No. 3648103)).

Since the flat cable described above is made by assembling a plurality of very thin coaxial cables by weaving them with a multiplicity of thin stretchable filaments, it has a large degree of freedom in the direction of bending or flexure. Further, since the filament used has a low coefficient of expansion and contraction so as not to adversely affect the electrical properties of the flat cable, the flat cable has high restorability. Thus, the flat cable can be freely bent or flexed, and since the very thin coaxial cables do not deviate freely from the woven mesh structure when the flat cable is bent or flexed, the restoring force acts so as to restore the original shape of the flat cable, and the original shape of the flat cable can be easily restored.

On the other hand, in the field of development of electronic apparatuses, such as personal data assistant, which have increasingly high performance and small size, use of the very thin flat cable as an internal wiring cable is in demand, since it is formed by weaving very thin coaxial cables with a multiplicity of thin filaments and adverse effect on the electrical properties, such as a characteristic impedance of the very thin coaxial cables can be reduced. Thus, in order to freely lay out the flat cable inside an electronic apparatus, there is strong demand to provide a flat cable that can be freely bent while maintaining its planar configuration and that permits the bent and deformed shape to be maintained.

DISCLOSURE OF THE INVENTION

In view of the various problems as described above, it is an object of the present invention to provide a flat cable that can be deformed freely while maintaining its planar configuration and that permits the deformed shape thereof to be maintained.

In order to attain the above-described object, the flat cable of the present invention, which comprises a plurality of cables each comprising at least a center conductor and a protective coating layer formed on the outer circumference of the center conductor, the cables being arranged in parallel and in a planar array to have a flat configuration, and the parallel cables being assembled by weaving each of a predetermined number of cables with a yarn, is characterized in that a warp yarn is disposed along an edge of the cable assembly in the width direction of the cable assembly and the yarn has a larger elongation as compared to the warp yarn.

Thus, with the flat cable according to the present invention, when the flat cable is bent, the yarn weaving the respective cables is stretched so that the yarn in the bent portion is elongated and the cables on the bent portion can deviate from the woven mesh structure of the cables and the yarn. Therefore, the flat cable according to the present invention can be deformed freely while maintaining the planar configuration thereof, and the deformed shape thereof can also be maintained.

The flat cable according to the present invention is characterized in that the length of the yarn increases under tension to at least 1.2 times as compared to the length thereof under no tension. With such a yarn, it is possible to bend the flat cable of the invention freely and to maintain the shape of the bent cable as it is.

Further, in the flat cable according to the present invention, it is preferable that the yarn contain polyurethane fiber. Also, in the flat cable according to the present invention, it is preferable that the yarn be a self-crimped yarn. With such construction, in the flat cable according to the present invention, it is possible to use, as the yarn for weaving the cables, a yarn that is stretched under tension to at least 1.2 times compared to the length of the yarn when it is subjected to no tension, so that it is possible to provide a flat cable that can be freely deformed while maintaining the planar configuration thereof and that permits the deformed shape thereof to be maintained.

The flat cable according to the present invention is also characterized in that the cables are coaxial cables. Thus, the flat cable according to the present invention can be formed from very thin coaxial cables, so that it is possible to provide a flat cable that can be laid out in the wiring space which present in a very small gap or a small space of a personal data assistant or the like.

The flat cable according to the present invention is also characterized in that the cable assembly can have different clearances between adjacent cables arranged in parallel and in a planar array. Thus, the flat cable according to the present invention can have different clearances between adjacent cables situated at the terminal end of the flat cable, so that it is possible to improve the workability of the cable end.

As can be seen from the above description, according to the present invention, the following effects can be obtained. Specifically, according to the present invention, a flat cable is formed by weaving a plurality of cables with a yarn that is stretched to at least 1.2 times the original length thereof, so that when the flat cable is bent, the yarn is elongated at the bent portion. Since the flat cable 100 is formed by weaving cables, these cables can slide relative to each other to some extent in the longitudinal direction of the flat cable, and it is possible for the cables to easily deviate from the weaving mesh structure at the bent portion. Thus, with the flat cable according to the present invention, it is possible to bend the flat cable flexibly while maintaining its planar configuration, and to permit cables in the bent portion from escaping from the weaving mesh structure of the cables and the yarn in accordance with the elongation of the yarn. Therefore, with the flat cable according to the present invention, it is possible to deform the flat cable freely while maintaining its planar configuration, and to maintain the deformed shape thereof as it is. Since the clearance between adjacent cables situated at the terminal end of the flat cable can be changed, it is possible to improve workability of the cable end.

BEST MODE FOR CARRYING OUT THE INVENTION

A first embodiment of the present invention will now be described with reference to the drawings. The embodiment described below is not intended to restrict the invention defined by appended claims. Further, the combination of all of the features described in the embodiment is not necessarily required in order to carrying out the present invention.

Figure 1:
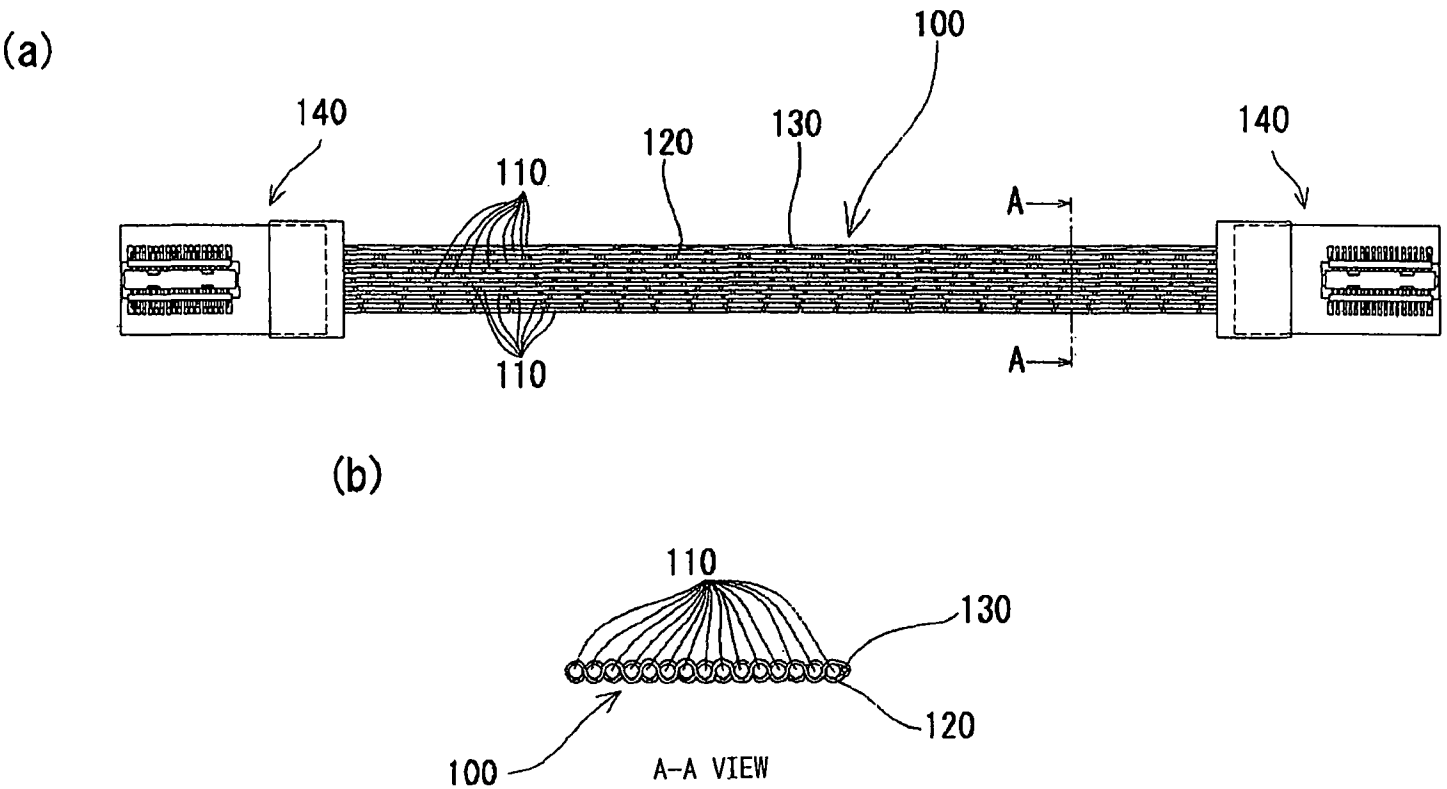
FIG. 1 is a view illustrating a very thin flat cable 100 according to an embodiment of the present invention, FIG. 1(*a*) showing a plan view of very thin flat cable 100, and FIG. 1(*b*) showing a sectional view of very thin flat cable 100.

First, referring to FIG. 1, a very thin flat cable 100 according to the first embodiment will be described. FIG. 1(*a*) is a view showing the construction of very thin flat cable (flat cable) 100 of the present embodiment, and FIG. 1(*b*) is a sectional view schematically showing very thin flat cable 100 along the arrow A-A shown in FIG. 1(*a*).

As shown in FIG. 1(*a*) and FIG. 1(*b*), very thin flat cable 100 of the present embodiment comprises a plurality of very thin coaxial cables (cables) 110 arranged in parallel and in a planar array, and each having an extremely small outer diameter, very thin coaxial cables 110 being woven with a weft yarn (yarn) 120 characteristic of the present invention such that the coaxial cables are woven, in units of a predetermined number of cables as required, by weft yarn 120, and weft yarn 120 passes alternately over and under them. On an edge in the width direction of the assembly of the plurality of adjacent very thin coaxial cables 110, a tangling yarn (warp yarn) 130 is additionally inserted in parallel arrangement. Connectors 140 are provided at both terminal ends of very thin flat cable 100.

In very thin flat cable 100, a yarn having an elongation of at least 20% is used as the weft yarn 120, the weft yarn 120 being repeatedly turned back at both edges in the width direction of the assembly of the plurality of very thin coaxial cables 110. Weft yarn 120 is arranged in zigzag form relative to the longitudinal direction of very thin flat cable 100, and the pitch of the zigzag form of weft yarn 120 is determined as desired such that the flat configuration of very thin flat cable 100 can be maintained. Weft yarn 120 is wound and fixed at the turning-back point so as not to cause deviation of the pitch of the zigzag form, and thus it is possible to maintain the flat configuration of very thin flat cable 100 even when it is deformed.

Further, the very thin flat cable has tangling yarn 130 at an end, at which weft yarn 120 is turned back at the tangling yarn 130 so that the tension of weft yarn 120 does not have a direct effect on very thin coaxial cables 110. Thus, very thin flat cable 100 according to the present embodiment is formed as a woven flat cable by leno-weaving.

Therefore, very thin flat cable 100 of the present embodiment can be maintained in flat configuration, while deformation thereof is not impeded by weft yarn 120. Further, since very thin flat cable 100 is formed in flat configuration by weaving, adjacent very thin coaxial cables 110 can slide to some extent relative to each other in the longitudinal direction of very thin flat cable 100. Therefore, it is possible to flexibly deform very thin flat cable 100 itself.

The thickness of weft yarn 120 used is such that when very thin coaxial cables 110 are woven, no rugged deformation is produced therein. Thus, it is possible to prevent an electrical property, such as the characteristic impedance of very thin coaxial cables 110 from being affected.

Very thin flat cable 100 of the present embodiment is formed by placing fifteen very thin coaxial cables 110 in parallel arrangement, and using them as warp yarns, and polyurethane fiber having a thickness of 78 dTX and an elongation of 600% as weft yarn 120, weaving very thin coaxial cables 110 into a leno cloth with weft yarn 120 and tangling yarn 130 of polyester having elongation of 6-7%. Very thin coaxial cable 110 used in very thin flat cable 100 of the present embodiment will be described below in detail with reference to FIG. 2.

Figure 2:
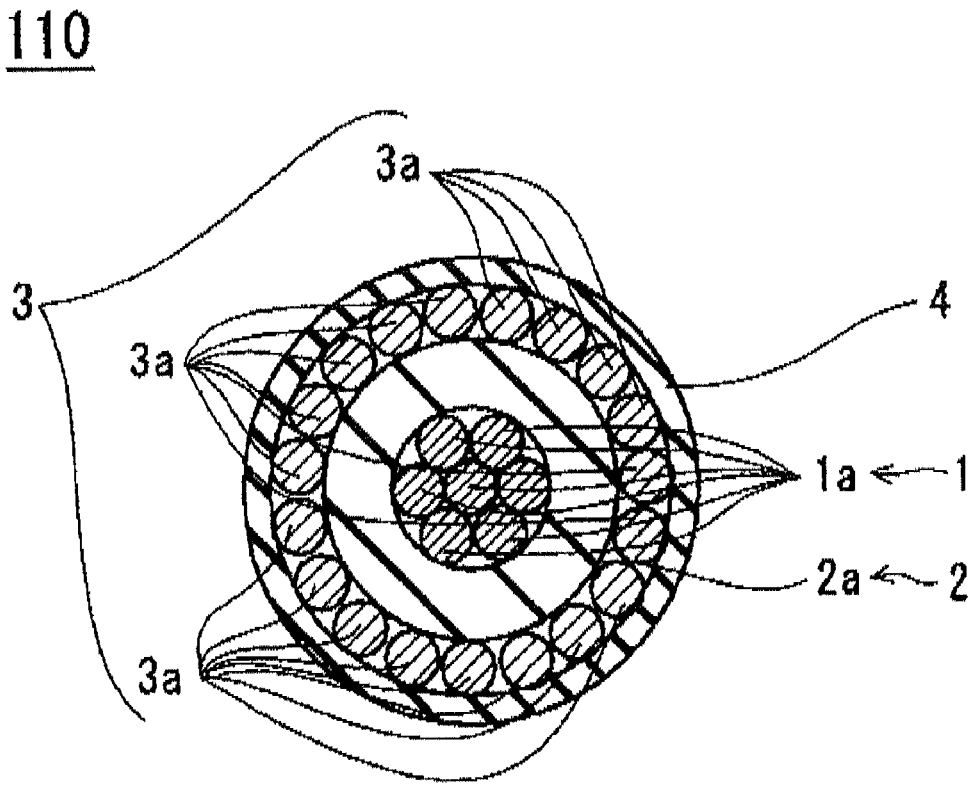
FIG. 2 is a sectional view of a very thin coaxial cable 110 in the embodiment.

FIG. 2 is a sectional view showing a very thin coaxial cable 110 of the present embodiment. Very thin coaxial cable 110 of the present embodiment comprises, as shown in FIG. 2, a center conductor 1 formed by twisting a plurality of conductors 1*a*, and a dielectric layer 2 formed by extrusion coating of a dielectric 2*a* on the outer circumference of center conductor 1 using an extruder (not shown). On the outer circumference of dielectric layer 2, outer conductor layer 3 is formed by laterally winding a plurality of conductor wires 3*a*, and on the outer circumference of outer conductor layer 3, a jacket (protective coating layer) 4 is formed by extrusion coating. Very thin coaxial cable 110 is formed in this manner. Very thin flat cable 100 of the present embodiment is formed by weaving each of a predetermined number of very thin coaxial cables 110, which are used as warp yarns, with weft yarn 12, as described above.

Very thin coaxial cable 110 of the present embodiment is constructed by forming center conductor 1 by twisting seven silver-plated tin-containing copper alloy wires having an outer diameter of 0.025 mm, forming dielectric layer 2 by coating a tetrafluoroethylene-perfluoroalkylvinyl ether copolymer (hereinafter referred to simply as PFA), which provides dielectric 2*a*, on the outer circumference of the center conductor 1 to an outer diameter of 0.16 mm, forming outer conductor layer 3 by laterally winding 19 tin-plated soft copper wires having an outer diameter of 0.3 mm, which represent conductor wires 3*a*, on the outer circumference of dielectric layer 2, and forming jacket 4 of PFA having a thickness of 0.03 mm by extrusion coating on the outer circumference of outer conductor layer 3, so that very thin coaxial cable 100 has an outer diameter of 0.28 mm. The cable shape of very thin flat cable 100 of the present embodiment when it is bent will now be described with reference to FIG. 3.

Figure 3:
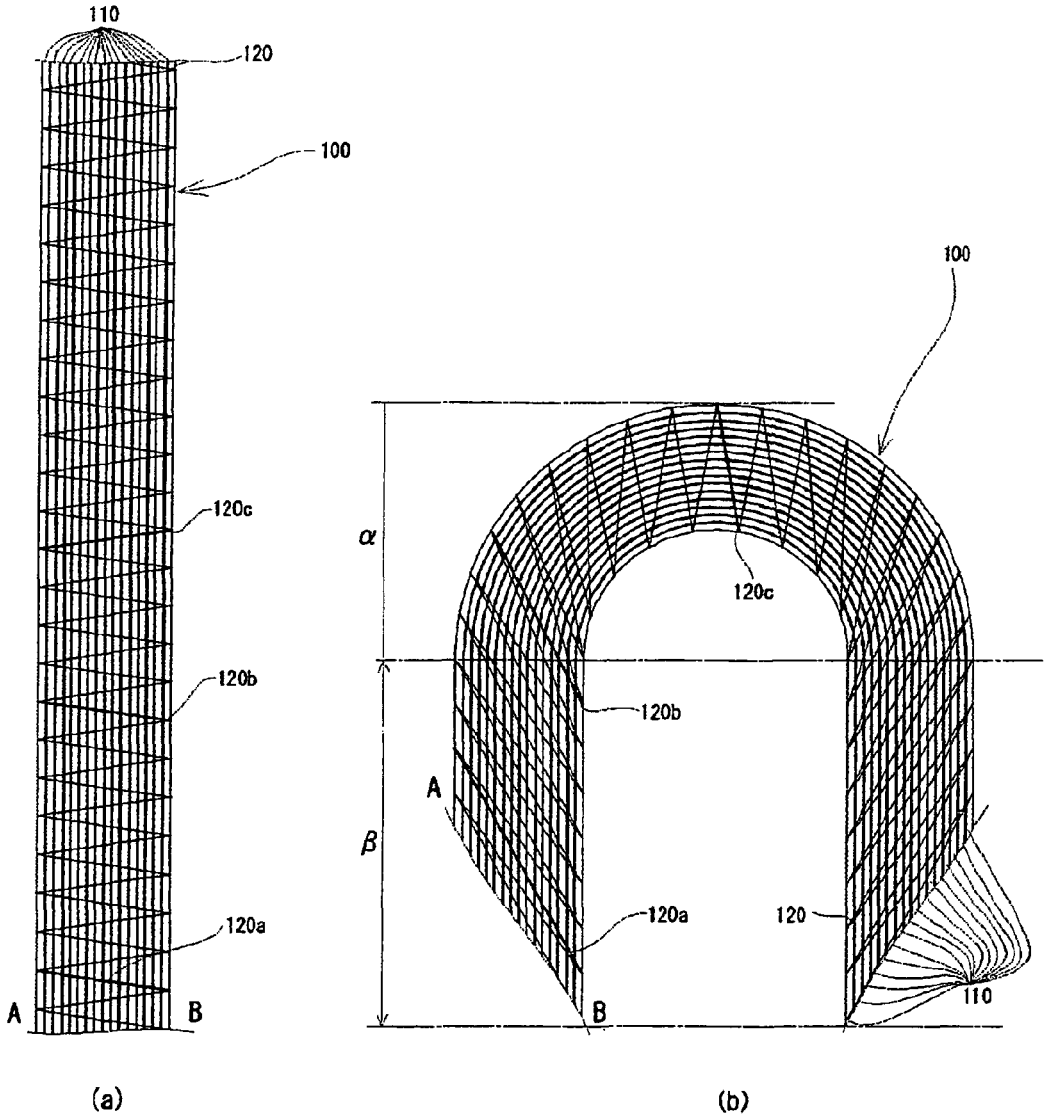
FIG. 3 is a view illustrating the cable shape before bending and the cable shape after bending of very thin flat cable 100 of the embodiment, FIG. 3(*a*) showing very thin flat cable 100 of the present embodiment before bending, and FIG. 3(*b*) showing very thin flat cable 100 of the present embodiment after bending.

FIG. 3 is a comparative illustration of the cable shape before bending of very thin flat cable 100 of the present embodiment with the cable shape after bending, wherein FIG.

3(*a*) shows the state of very thin flat cable 100 of the present embodiment before bending, and FIG. 3(*b*) shows the state thereof after bending.

As shown in FIG. 3(*a*), when very thin flat cable 100 of the present embodiment is not bent, the pitch of the zigzag form of weft yarn 120 is constant, so that the length of weft yarn 120 in the width direction of very thin flat cable 100 is approximately constant at any point. For example, as shown in FIG. 3(*a*), a first weft yarn 120*a*, a second weft yarn 120*b*, and a third weft yarn 120*c* are all nearly the same length.

When very thin flat cable 100 of the present embodiment is bent such that a bending angle of 180 degrees is imparted to third weft yarn 120*c* of the center of the flat cable while maintaining the flat configuration thereof, the cable has two portions, α-portion where very thin coaxial cables 110 are deformed into curved shape while being maintained in parallel arrangement, and β-portion where very thin coaxial cables 110 are maintained in parallel while being held in the straight arrangement, as shown in FIG. 3(*b*). Since the weft yarn 120 is wound and fixed at the turning-back point, the length thereof in the width direction of very thin flat cable 100 increases in accordance with deformation of very thin flat cable 100.

The amount of elongation of weft yarn 120 varies with the position of the center of bending very thin flat cable 100. As shown in FIG. 3(*b*), first weft yarn 120*a* in β-portion that is situated farthest away from the center of bending is elongated to nearly twice the original length thereof. On the other hand, the length of third weft yarn 120*c* in α-portion that is situated near the center of bending changes very little, while the length of second weft yarn 120*b* that is situated in-between increases to about 1.7 times the original length thereof.

This is because when very thin flat cable 100 is bent, a difference in its circumference occurs in α-portion between side A that corresponds to the outer side of very thin flat cable 100 and side B that corresponds to the inner side thereof. Thus, in α-portion, the length of very thin coaxial cable 110 on side A is greater than that of very thin coaxial cable 110 on B side by about the product of the width of very thin flat cable 100×2π. However, since weft yarn 120 is wound and fixed so as not to cause a shift in the position thereof, the displacement of the wound and fixed position of weft yarn 120 is very small. Thus, in α-portion, the number of points where weft yarn 120 is wound and fixed differs between side A and side B, and the number is greater on side A than on side B.

Therefore, when very thin flat cable 100 is deformed so as to be curved, the distance between the wound and fixed position on side A and the wound and fixed position on side B of weft yarn 120 changes in accordance with the difference in circumference of very thin flat cable 100. Since the difference in circumference of very thin flat cable 100 increases gradually from the center position of α-portion toward the boundary between α-portion and β-portion and is greatest at the boundary between α-portion and β-portion, change in length of weft yarn 120 is greatest for the weft yarn the wound and fixed position of which is on side A near the boundary between α-portion and β-portion.

In β-portion, very thin coaxial cables 110 of very thin flat cable 100 are arranged in parallel and linearly. Thus, the original distance between the wound and fixed position on side A and the wound and fixed position on side B of weft yarn 120 is not changed. Therefore, all of weft yarns 120 in β-portion are repeatedly turned back in accordance with the circumferential difference of very thin flat cable 100 in α-portion. Accordingly, among first weft yarn 120*a*, second weft yarn 120*b*, and third weft yarn 120*c*, first weft yarn 120*a* in β-portion exhibits the greatest change in length.

In very thin flat cable 100 of the present embodiment, weft yarn 120 is formed of polyurethane fiber having an elongation of 600%. Thus, even when it is bent so as to curve with a bending angle of 180 degrees as shown in FIG. 3(*b*), weft yarn 120 can be elongated up to the length of first weft yarn 120*a*. Therefore, very thin flat cable 100 of the present embodiment can be deformed for bending while maintaining the flat configuration thereof so as to have a bending angle of 180 degrees.

Also, with very thin flat cable 100 of the present embodiment, it is possible to improve the workability of the cable end processing. Next, improvement of workability of the end processing of very thin flat cable 100 according to the present embodiment will be explained with reference to FIG. 4.

Figure 4:
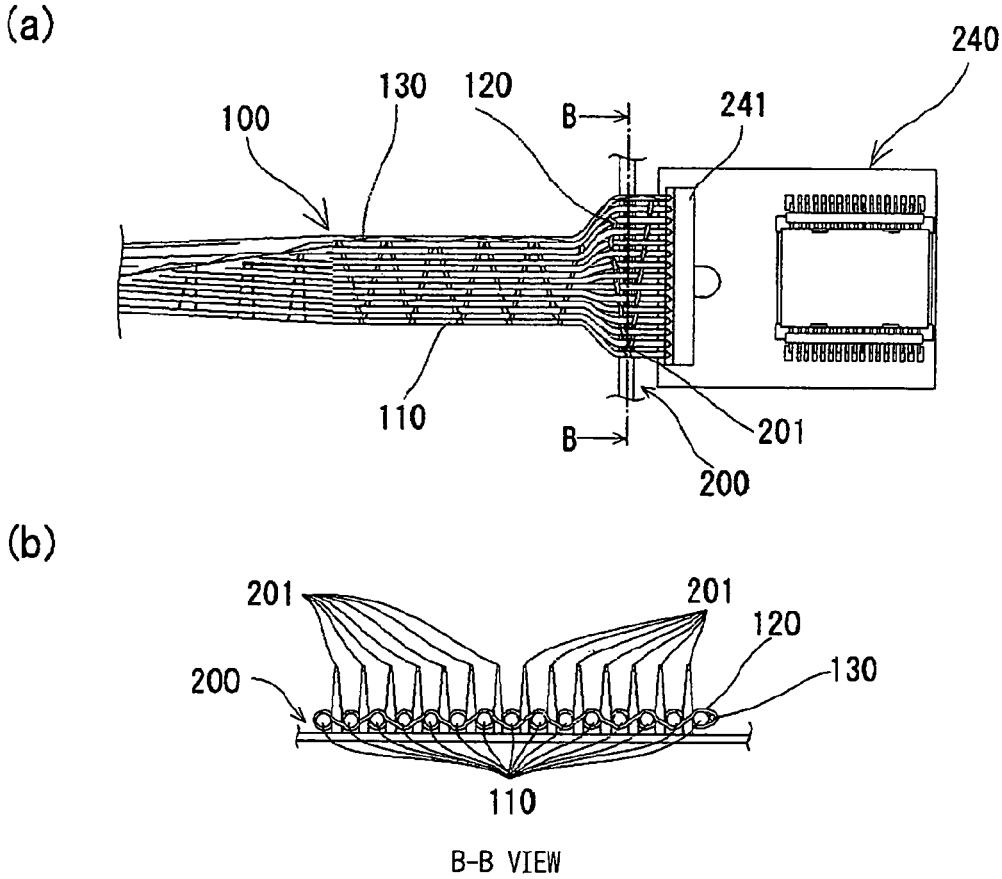
FIG. 4 shows an example of processing the end of very thin flat cable 100 of the embodiment, FIG. 4(*a*) showing a plan view of very thin flat cable 100 at the time of end processing, and FIG. 4(*b*) showing a sectional view of very thin flat cable 100 at the time of end processing.

FIG. 4 shows an example of processing an end of very thin flat cable 100 of the present embodiment, FIG. 4(*a*) showing a plan view of very thin flat cable 100 at the time of such processing, and FIG. 4(*b*) showing a sectional view of very thin flat cable 100 along the arrow B-B shown in FIG. 4(*a*) at the time of end processing.

As shown in FIG. 4(*a*) and FIG. 4(*b*), since the weft yarn 120 that provides very thin flat cable 100 by weaving is formed of stretchable polyurethane fiber, the pitch between adjacent very thin coaxial cables 110 increases when a tension is applied to very thin flat cable 100 in the width direction. Therefore, in very thin flat cable 100 of the present embodiment, simply by using a comb-like expansion jig 200, for example, and inserting a plurality of the comb teeth 201 of expansion jig 200 between respective adjacent ones of a plurality of very thin coaxial cables 110, weft yarn 120 can be stretched to increase the pitch between adjacent very thin coaxial cables 110 in conformity with the shape of expansion jig 200, as shown in FIG. 4(*a*) and FIG. 4(*b*).

With this construction, when a wide connector 240 with a connector terminal 241 having a width greater than that of very thin flat cable 100 of the present embodiment is used in end connection work, the connection work can be performed in the condition wherein the pitch between adjacent very thin coaxial cables 110 is increased by expansion jig 200. Therefore, very thin flat cable 100 of the present embodiment can be connected to connector terminal 241 in the condition wherein very thin coaxial cables 110 are brought close to respective contacts of the connector terminal 241.

Since, in very thin flat cable 100 of the present embodiment, the pitch between adjacent very thin coaxial cables 110 can be increased, they can be made into a plurality of bundles of very thin coaxial cables. Therefore, when a plurality of connectors are to be connected to one very thin flat cable 100, for example, when respective three sets each of five very thin coaxial cables 110 of very thin flat cable 100 are bundled, and are connected to three connectors corresponding to respective bundles, connection work can be performed for each bundle with the remaining bundles being separated from the bundle connected.

Further, in very thin flat cable 100 of the present embodiment, very thin coaxial cables 110 can be bundled in plural numbers. Accordingly, even in the case where connectors are disposed in narrow confined areas, and therefore a plurality of very thin flat cables had to be used for connection in the past, it is possible, by use of only one very thin flat cable 100 of the present embodiment, to achieve the connection. Thus, for the reasons given above, it is possible to improve workability of the cable end processing with very thin flat cable 100 of the present embodiment.

In the present embodiment, very thin coaxial cables 110 are woven with weft yarn 120 and tangling yarn 130 to form very thin flat cable 100. However, the cables used in the flat cable of the invention are not limited to coaxial cables, such as very thin coaxial cables 110, and so-called simple cables, i.e., cables each having a center conductor and an insulator coated on the outer circumference of the center conductor, may be used.

Although polyurethane fiber having a thickness of 78 dTX and an elongation of 600% is used as weft yarn 120 in the very thin flat cable of the present embodiment, the weft yarn for the flat cable of the invention is not limited to this. A covered yarn which has polyurethane fiber as a core and has nylon or polyester wound on it, or a core-spun yarn which includes polyurethane fiber as a core inserted during spinning process of cotton or wool, or a self-crimped yarn or the like, may be used as the weft yarn, provided that it permits the flat cable to be freely deformed while maintaining its planar configuration and permits the deformed shape thereof to be held.

Also, the thickness of the weft yarn may be freely changed in order to change the pitch between adjacent cables or in conformity with the cable diameter. However, in view of the strength of the flat cable, the yarn used as the weft yarn preferably has a thickness of greater than 22 dTX. As in the embodiment where very thin coaxial cables 110 are used to form the flat cable, there is a possibility that working efficiency will be degraded if the thickness of the weft yarn is too great. Therefore, it is preferable that a yarn used as the weft yarn have a thickness less than 200 dTX.

Further, in the present invention, it is preferable that the weft yarn have an elongation of not less than 20% and not greater than 1000%. This is because if the elongation of the weft yarn is not greater than 20%, it may become difficult to deform the flat cable freely, and if the elongation of the weft yarn is not less than 1000%, workability may be reduced in the process of arranging cables in parallel and weaving them. When various pitches between adjacent cables are used, it is preferable that the weft yarn have greater elongation, since this permits the pitches to be varied in a wide range.

Although very thin flat cable 100 of the present embodiment uses polyurethane fiber having an elongation of 600% as weft yarn 120, so that it is possible to bend very thin flat cable 100 freely up to the angle of 180 degrees, the flat cable of the invention is not limited to this embodiment. For example, it may be one which uses a yarn having an elongation of 20% as the weft yarn and can be bent freely up to an angle of about 130 degrees.

Although leno weaving is used for very thin flat cable 100 of the present embodiment, the manner of weaving for the flat cable of the invention is not limited to this. For example, plain weaving may be used for the flat cable.

Since it is possible to deform the flat cable of the invention freely while maintaining the planar configuration of the flat cable and to maintain the deformed shape as it is, the flat cable can be bent to have a certain bending angle while being connected, at one end thereof, to a connector, for example, and in this state, the cables at the other end can be cut uniformly to provide a flat cable in which all cables arranged in parallel have different lengths. Thus, in the invention, it is possible to simply form a flat cable in which all cables arranged in parallel have different lengths. Therefore, it is possible to attach a connector corresponding to the flat cable in which all cables arranged in parallel have different lengths, and to arbitrarily select an attaching angle of the connector accordingly.

As has been described above, in very thin flat cable 100 of the present embodiment, polyurethane fiber having an elongation of 600% is used as weft yarn 120, and a plurality of very thin coaxial cables 110 are woven with weft yarn 120 and tangling yarn 130 to form very thin flat cable 100, so that when very thin flat cable 100 is bent, weft yarn 120 is elongated at the bent portion. Since very thin flat cable 100 is formed by weaving, very thin coaxial cables 110 can slide relative to each other in the longitudinal direction of very thin coaxial cables 110, and very thin coaxial cables 110 at the bent portion can easily deviate from the woven mesh structure.

With such construction of very thin flat cable 100 of the present embodiment, it is possible to flexibly bend very thin flat cable 100 while maintaining the planar configuration thereof, and to permit very thin coaxial cables 110 in the bent portion to deviate from the woven mesh structure of very thin coaxial cables 110 and weft yarn 120 in accordance with the elongation of weft yarn 120. Thus, very thin flat cable 100 of the present embodiment can be freely deformed while maintaining the planar configuration thereof, and the deformed shape thereof can be maintained as it is. Further, very thin coaxial cables 110 situated at the terminal end of very thin flat cable 100 can have different pitches, so as to improve the workability of the ends of very thin coaxial cables 110.

Industrial Applicability

The flat cable of the invention is applicable to various apparatuses. For example, it can be applied to electronic apparatuses, such as calculators, computers, medical apparatuses and the like, and can also be applied to control circuits of machines, such as automobiles, airplanes and the like, where control equipment needs to be mounted in a narrow space. It is also applicable to mobile terminal devices, such as cellular phones, PDAs, laptop personal computers and the like, where size reduction is increasingly required.

The invention claimed is:

1. A flat cable comprising:

a plurality of cables arranged in parallel and in a planar array to have a flat configuration, each cable having at least a center conductor and a protective coat layer coated on an outer circumference of said center conductor, wherein the plurality of parallel cables are assembled by weaving each of a predetermined number of the cables with a weft yarn to form a cable assembly; and a tangling yarn disposed only along an edge in a width direction of the cable assembly, wherein said weft yarn has a greater elongation compared to an elongation of said tangling yarn, and wherein when the flat cable is bent, each weft yarn weaving a respective cable is configured to stretch so that the weft yarn in a bent portion is elongated and the cables in the bent portion are configured to deviate from a woven mesh structure of the cables and the weft yarn to maintain a planar configuration of the bent cable.

2. The flat cable according to claim 1, wherein said weft yarn is elongated, when tension is applied thereto, up to at least 1.2 times the length of said weft yarn when no tension is applied thereto.

3. The flat cable according to claim 1, wherein said weft yarn comprises polyurethane fiber.

4. The flat cable according to claim 1, wherein said weft yarn is a self-crimped yarn.

5. The flat cable according to claim 1, wherein said plurality of cables are coaxial cables.

6. The flat cable according to claim 1, wherein the cable assembly has different clearances between adjacent cables arranged in parallel and in a planar array.

* * * * *